US005367937A

United States Patent [19]

Epping

[11] Patent Number: 5,367,937

[45] **Date of Patent: * Nov. 29, 1994**

[54] HARMONICA

[76] Inventor: William R. Epping, 108 N. James St., Ashland, Va. 23005

[ * ] Notice: The portion of the term of this patent subsequent to Jan. 26, 2010 has been disclaimed.

[21] Appl. No.: 7,263

[22] Filed: Jan. 21, 1993

Related U.S. Application Data

[63] Continuation-in-part of Ser. No. 750,874, Aug. 26, 1991, Pat. No. 5,182,413.

[51] Int. Cl.[5] ..... G10D 7/12

[52] U.S. Cl. ..... 84/377

[58] Field of Search ..... 84/377, 378, DIG. 14, 84/375

[56] References Cited

U.S. PATENT DOCUMENTS

| | | | |
|---|---|---|---|
| 3,580,125 | 5/1971 | Heatwole | 84/377 |
| 3,674,910 | 7/1972 | McKenzie | 84/377 |
| 5,166,461 | 11/1992 | Salwitz et al. | 84/377 |
| 5,182,413 | 1/1993 | Epping | 84/377 |

*Primary Examiner*—Michael L. Gellner
*Assistant Examiner*—Patrick J. Stanzione

[57] ABSTRACT

A harmonica with increased musical range and volume is disclosed. The technique used to produce some of the additional notes is called bending. To increase the musical range of the instrument, the harmonica has four reeds per reed cell. Two of the reeds are traditional blow and draw reeds and the other two reeds are enabler reeds for enabling the blow and draw reeds to both be bent to lower frequencies. All four reeds have check valves which are essential for the enabler reeds to preclude unwanted sympathetic vibration in adjacent cells. One embodiment permits a single valve to serve two reeds.

8 Claims, 11 Drawing Sheets

| | | | | | | | | | | |
|---|---|---|---|---|---|---|---|---|---|---|
| BLOW REED ENABLER | Bb | D | E | Bb | D | E | Bb | D | E | A |
| POSSIBLE BLOW BENT NOTES | B | Eb | F<br>F# | B | Eb | F<br>F# | B | Eb | F<br>F# | Bb<br>B |
| BLOW REED | C | E | G | C | E | G | C | E | G | C |
| DRAW REED | D | G | B | D | F | A | B | D | F | A |
| POSSIBLE DRAW BENT NOTES | C# | F#<br>F | A#<br>A<br>G# | C# | E | G#<br>G | Bb<br>A | C# | E | G# |
| BLOW REED ENABLER | C | E | G | C | Eb | F# | G# | C | Eb | G |
| HOLE # | 1 | 2 | 3 | 4 | 5 | 6 | 7 | 8 | 9 | 10 |

*FIG. 8*

| | | | | | | | | | | |
|---|---|---|---|---|---|---|---|---|---|---|
| BLOW REED ENABLER | Bb | D | E | Bb | D | E | - | - | - | - |
| POSSIBLE BLOW BENT NOTES | B | Eb | F<br>F# | B | Eb | F<br>F# | - | Eb | F# | Bb<br>B |
| BLOW REED | C | E | G | C | E | G | C | E | G | C |
| DRAW REED | D | G | B | D | F | A | B | D | F | A |
| POSSIBLE DRAW BENT NOTES | C# | F#<br>F | A#<br>A<br>G# | C# | - | G# | Bb<br>A | C# | E | G# |
| BLOW REED ENABLER | - | - | - | - | - | - | G# | C | Eb | G |
| HOLE # | 1 | 2 | 3 | 4 | 5 | 6 | 7 | 8 | 9 | 10 |

*FIG. 9*

| HOLE # | 1 | 2 | 3 | 4 | 5 | 6 | 7 | 8 | 9 | 10 |
|---|---|---|---|---|---|---|---|---|---|---|
| POSSIBLE BLOW BENT NOTES | A#<br>B | D<br>D# | F<br>F# | A#<br>B | D<br>D# | F<br>F# | A#<br>B | D<br>D# | F<br>F# | A#<br>B |
| BLOW REED | C | E | G | C | E | G | C | E | G | C |
| DRAW REED | D | G | B | D | F | A | B | D | F | A |
| POSSIBLE DRAW BENT NOTES | C#<br>C | F#<br>F | A#<br>A<br>G# | C#<br>C | E<br>D# | G#<br>G | A#<br>A | C#<br>C | E<br>D# | G#<br>G |

*FIG. 12*

HARMONICA

This is a continuation-in-part of U.S. patent application Ser. No. 07/750,874 which is due to be issued as U.S. Pat. No. 5,182,413 on Jan. 26, 1993.

This invention relates to harmonicas or mouth organs, specifically to an increase in the musical range and sound volume of such instruments.

BACKGROUND OF THE INVENTION

It is known by most persons skilled in the art of harmonica playing that approximately 31 notes can be obtained on a 10 cell, 20 reed, diatonic harmonica. This type of harmonica is commonly called the blues harmonica, or blues harp. In this type of harmonica, two reeds, a blow reed and a draw reed, are situated in each cell.

Ten distinct musical notes, the blow notes, can be obtained in the blues harmonica by blowing into the instrument. One distinct note is produced in each of the ten cells. These blow notes are produced when air is blown into a cell with the oral cavity open, causing the blow reed to vibrate and therefore produce a musical note.

Ten additional distinct musical notes are obtained in the blues harmonica by drawing air through the instrument, one note per each of the ten cells. These are the draw notes, and are produced when air is drawn from that particular cell with the oral cavity fully open, causing the draw reed in that particular cell to vibrate and sound.

It is also commonly known by most professional or amateur harmonica players today that seven or eight additional notes can be obtained in the blues harmonica by the bending technique. The bending technique utilizes both reeds in a particular cell of the harmonica to produce a musical note distinct from the blow or draw note that can be obtained from that cell.

Bending a reed in a harmonica implies producing a lowering of pitch by shaping the mouth and restricting the air flow in the oral cavity while blowing or drawing, stimulating the reed not normally played when either blowing or drawing to produce a note higher than it would if it were being played In the normal manner but lower than that of the higher pitched reed.

In cells 1 through 6 of the standard 10 cell, 20 reed, diatonic harmonica, the blow reed is tuned lower in pitch than the draw reed. The notes that can be bent in holes 1 through 6 are the draw notes. When drawing on a cell in this range, and with the mouth in the bending position, the blow reed is caused to vibrate sympathetically with the draw reed. This causes a lowering of pitch in that cell to a single pitch that is somewhere between the two original pitches to which the two reeds were tuned.

In cells 7 through 10 of the blues harmonica, the draw reed is tuned lower in pitch than the blow reed. To produce a bent note in one of these cells, the mouth is put into the bending position, while blowing, and the pitch of the blow reed is lowered to a single tone that is somewhere between the two original pitches to which the blow and draw reed were tuned.

Not all of the ten higher pitched reeds can be bent practically to a distinct chromatic tone with the bending technique. For two cells, 5 and 7, the difference in pitch between the blow and draw is only one semitone, and so the amount you can bend the note is only approximately a quarter tone, which isn't enough to produce a distinctly different musical tone found in the chromatic scale.

The disadvantages of this type of harmonica are:

(a) The total musical range of the instrument is limited to approximately 31 notes. Most musicians who learn to bend notes on the blues harmonica usually wish to be able to bend all the 20 blow and draw notes, but this is just not possible with the present state of art.

(b) The harmonica is not able to obtain a complete chromatic scale, chromatic tones being those that are foreign to the diatonic scale. In the present state of art, the blues harmonica is only able to achieve a diatonic, or normal, scale of eight tones to the octave plus a limited number of accidentals.

(c) The present art does not allow a player to obtain a glissando, or sliding up and down the musical scale, to impart a more fluid and live quality to the music on each and every reed of the harmonica.

Accordingly, several objects and advantages of this invention are:

(a) to increase the musical range of the harmonica:

(b) to enable a player to achieve a complete chromatic scale with the harmonica;

(c) to allow a player to obtain a glissando on each and every reed, thereby imparting a more fluid and live quality to the music; and (d) to increase the volume of the instrument.

BRIEF DESCRIPTION OF THE DRAWINGS

FIG. 8 is a table showing the notes to which the reeds are tuned and the musical notes that can be obtained in the preferred embodiment, the 40-reed harmonica shown in FIG. 1 when it is tuned to key C.

FIG. 9 is a table showing the notes to which the reeds are tuned and the musical notes that can be obtained in the second embodiment, the 30-reed harmonica shown in FIG. 6 when it is tuned to key C.

FIG. 12 is a table showing the notes to which the reeds are tuned, and the notes that can be obtained when using the technique of bending with the third embodiment.

REFERENCE NUMERALS IN DRAWINGS

Figure 1:
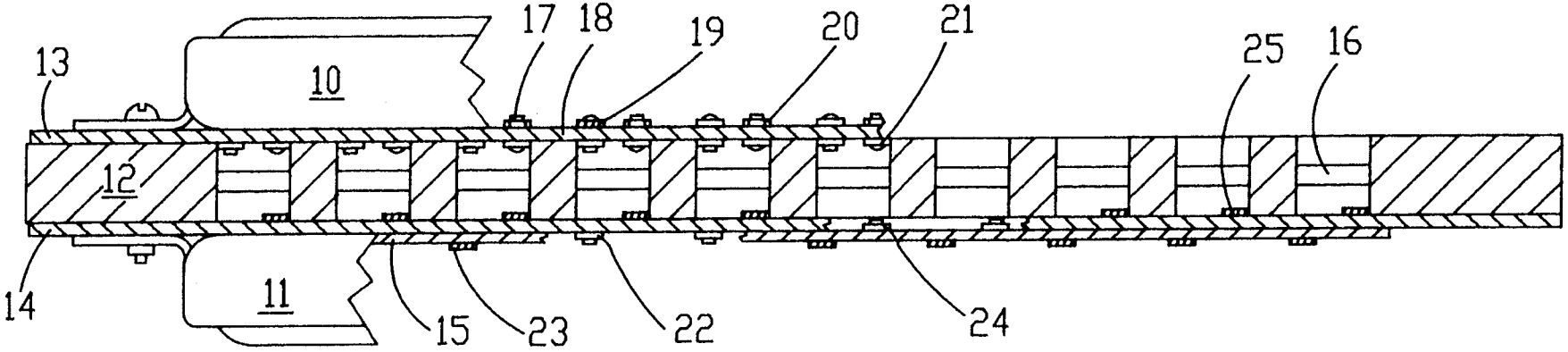
FIG. 1 shows a front elevational view, partially broken away, looking into the cells of the bending harmonica, showing four reeds per reed cell.

7 sound hole 8 draw reed plate
9 flow reed plate
10 top cover
11 bottom cover
12 comb
13 first reed plate
13' first reed plate slot
14 inside or second reed plate
15 outside or third reed plate
16 reinforcement bar
17 rivet
18 blow reed
19 blow reed valve
19 ' blow reed/blow enabler reed valve
20 draw reed
21 draw reed valve
21' draw reed/draw enabler reed valve
22 blow enabler reed
23 blow enabler reed valve
23' blow reed/blow enabler reed valve slot
24 draw enabler reed
24' reed slot
25 draw enabler reed valve
25= draw reed/draw enabler reed valve slot
26 inside reed plate large slot
26' inside reed plate small slot
27 outside reed plate large slot
27' outside reed plate small slot
28 draw reed in motion
29 draw reed valve while draw reed is in motion
30 draw enabler reed in motion while producing bent note
31 draw enabler reed valve while draw reed is being bent
32 blow reed in motion
33 blow reed valve while blow reed is in motion
34 blow enabler reed in motion producing bent note
35 blow enabler reed valve while blow reed is being bent
36 adhesive line between valve and rivet
36' adhesive line between valve and valve platform
37 cell wall
38 mouthpiece opening
39 blow valve platform
40 draw valve platform
41 blow valve cell
42 draw valve cell
43 cover screw
44 cover nut
45 reed plate screw
46 reed plate nut

DETAILED DESCRIPTION OF THE INVENTION

A front elevational view, partially broken away, looking down into the cells is shown in FIG. 1. There is shown a top cover of a harmonica 10, partly broken away, a top or first reed plate 13, partly broken away, containing the blow reed 18 and blow reed valve 19, and a draw reed 20 and draw reed valve 21. The body of the harmonica includes the comb of the harmonica 12, along with the reinforcement bar 16, which is actually a part of the comb. FIG. 1 further shows the bottom inside reed plate 14, partly broken away, to expose the draw reed enabler 24. Also shown is the bottom outside or third reed plate 15, partly broken away to expose the blow enabler reed 22, also showing the draw enabler reed valve 25, glued onto the bottom inside or second reed plate 14, and the blow enabler reed valve 23 glued onto the bottom outside or third reed plate 15, along with the bottom cover 11.

The top cover 10 and bottom cover 11 serve the function of protecting the reeds and the reed valves from damage, and so that you can hold the instrument conveniently without touching the reeds and the reed valves. They also act as a resonator for the reeds.

The comb 12 differs from a comb in a standard harmonica. In order to accommodate the additional two reeds that are not in a standard harmonica, the reed cell walls of necessity are considerably narrower, typically 1 millimeter, than the reed cell walls in a ten-hole 20 reed harmonica, which are about 3 millimeters in thickness. They are the same thickness as the reed cell walls in a standard chromatic harmonica which also has two draw and two blow reeds per reed cell.

The mouthpiece, which is an integral part of the comb 12, on this embodiment is not the same as the mouthpiece on a chromatic harmonica. A 10 cell chromatic harmonica has a slide assembly which creates twenty cells, and the openings to these cells typically measure 4 millimeters in width by 5 millimeters in height. This embodiment has the mouthpiece of the standard 10-cell diatonic harmonica with the inner cell wall thinned down to allow the extra reeds. This is a unique comb design. The openings to the cells on this embodiment typically measure 6.35 millimeters width by 6.5 millimeters height.

The comb 12 in FIG. 1 would usually be made either of plastic or metal. In the case of this embodiment, wood would normally not be used as it would be too difficult to machine, would require a complicated design, and would make the cell walls too weak, since they are typically only 1 millimeter thick. Plastic would be the preferred material of construction for the comb 12, since it is easy to mold into the required shape. This plastic would be the same type as used presently in standard 10 cell, 20 reed, diatonic harmonicas.

FIG. 1 shows an embodiment which contains 10 cells to produce music. The invention would not however, be limited to 10 cells. These novel features could be used in a 12 or 16 hole model, which would expand the musical range of the instrument. Such a design could be used instead of a 12 or 16 hole chromatic harmonica, to eliminate the use of a slide mechanism to be able to bend to obtain the chromatic scale.

The scale of the mouthpiece on the four reed version shown in FIG. 1, the first embodiment of the invention, is the same as the scale on a chromatic harmonica. The spacing of the holes on this embodiment, measuring from the leading edge of one cell to the leading edge of the next, match up with the spacing on a chromatic harmonica. The sum of the hole width plus the dividing wall in this embodiment is equivalent to that in a chromatic harmonica. However, since the dividing wall between the mouthpiece openings is typically 2 millimeters in the chromatic harmonica versus 3 millimeters in the first embodiment, the outer opening in the mouthpiece differs between the two types. A typical mouthpiece opening to a cell in the embodiment shown in FIG. 1 measures 6.5 millimeters in height by 6.35 millimeters in width, as compared to an outer mouthpiece opening in the chromatic of 8 millimeters in height by 7 millimeters in width. A mouthpiece hole size on a standard 10 cell, 20 reed, diatonic harmonica would typically measure 5.5 millimeters height by 5 millimeters width, and the hole spacing is tighter than for the harmonica shown in FIG. 1.

Figure 2:
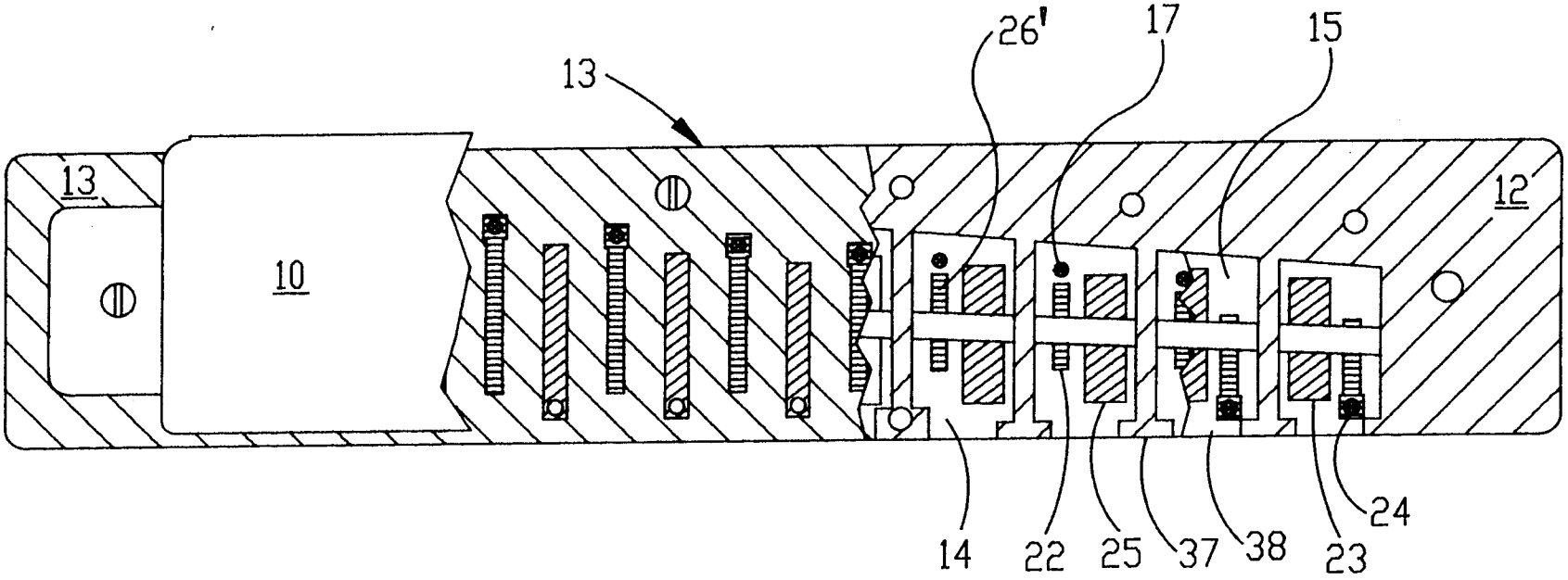
FIG. 2 is a top plan view, partially broken away, of the harmonica in FIG. 1.

FIG. 2 is a top plan view, partially broken away, of the harmonica in FIG. 1. FIG. 2 shows the first reed plate 13 and the top cover 10. The draw reeds 20 are shown riveted to the top reed plate 13 and the blow reed valves 19, that is, the valves covering the blow reed slots are shown glued to the first reed plate 13. A small circle shown at the edge of the blow reed valve 19 represents a small hump in the blow reed valve 19 to accommodate the bit of the rivet sticking out. The blow reed valve 19 covers the end of the rivet sticking out, but it is glued in place over the end of the rivet. A plastic cement, similar to airplane glue, is used to glue the valves in place.

Farther to the right in FIG. 2, to the cutaway, is shown the comb 12 with the cell wall 37 and the mouthpiece opening 38. The cell wall 37 is wider at the end to form the mouthpiece opening 38. This makes it possible to isolate that cell with the mouth thereby enabling the player to play only one cell at a time and therefore control what musical note is played. The cell wall 37 must be wide enough at the mouthpiece to isolate each of the holes. A typical dimension of the width of the cell wall 37 at the mouthpiece opening 38 in this embodiment is 3 millimeters and a typical width of the cell wall 37 beyond the mouthpiece opening 38 is 1 millimeter.

In the right of FIG. 2 is shown the reinforcement bar 16. The reinforcement bar 16 serves the purpose of strengthening and stabilizing the cell walls 37, since they are so narrow, and prevents them from bending back and forth while being played. The reinforcement bar 16 runs along the midsection of the cells and, along with the comb 12, is all a single piece of molded plastic.

In FIG. 2, viewing down through the reed cell, past the reinforcement bar 16 is shown the blow enabler reed 22 with the underside of the rivet 17 that it is attached with. The blow enabler reed 22 is viewed through its reed slot in the bottom inside reed plate 14. The blow enabler reed 22 is attached to the bottom inside reed plate 14 with a rivet 17. The end of the blow enabler reed 22 that is attached in FIG. 2 to the bottom side of the bottom inside reed plate 14. The opposite end of the blow enabler reed 22 is unattached, and therefore free to vibrate. The free end of the blow enabler reed 22 is flush at the end with the wall of the reed slot, and the free end is sloped such from the attached end that it is practically level with the top surface in this view of the bottom inside reed plate 14.

In the same cell in FIG. 2 that is shown the blow enabler reed 22 is also shown the draw enabler reed valve 25. In the next two cells to the right in FIG. 2 is a cutaway in what would be cells 9 and 10 of the embodiment. In this cutaway is shown the blow enabler reed valve 2 3 and the draw enabler reed 24.

Figure 3:
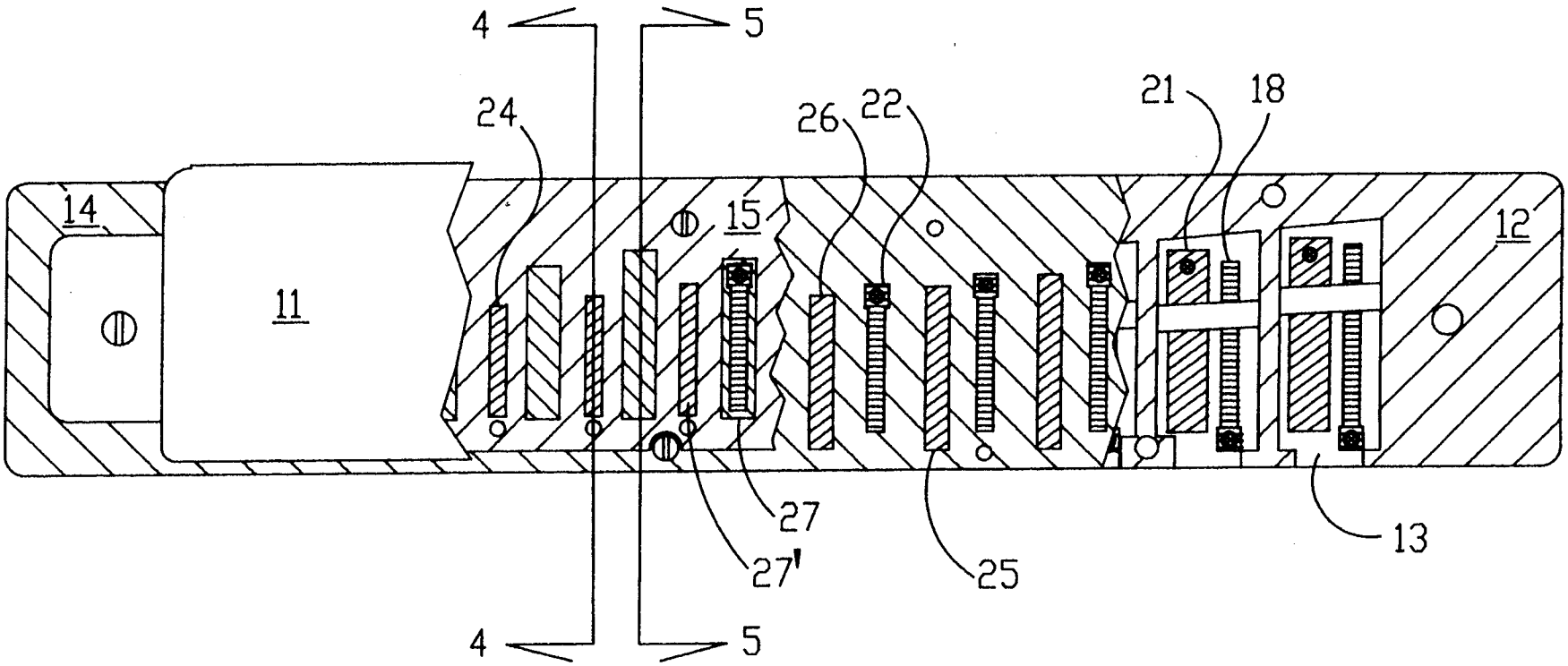
FIG. 3 is a bottom plan view, partially broken away, of the harmonica in FIG. 1.

Illustrated in FIG. 3 is a bottom plan view partly broken away, showing from left to right, the inside or second reed plate 14, and the bottom cover 11. Moving left to right in this drawing would be progressing sequentially from cells 10 to 1 of the embodiment, since this is a bottom view. The bottom outside reed plate 15 does not extend past the bottom cover 11, but is contained within the confines of the two cover plates. Attached to the outside or third reed plate 15 is the draw enabler reed 24, viewed from underneath, through its slot in the outside or third reed plate 15, and the blow enabler reed valve 23. Continuing to the right in FIG. 3, in what would be cell 6 of this embodiment, is shown the blow enabler reed valve 23 removed to show the outside reed plate large slot 27 in the outside or third reed plate 15 that goes around the blow enabler reed 22.

The outside reed plate large slot 27 in the outside or third reed plate 15 is large enough to accommodate the entire head of the blow enabler reed 22, the head being the end of the reed that is not free to vibrate. The head is the riveted end of the reed. Progressing farther right in FIG. 3, in the next cutaway, is shown the bottom inside reed plate 14 with the blow enabler reed 22 and draw enabler reed valve 25. The draw enabler reed valve 25 viewed through the inside reed plate large slot 26, where it's viewed from underneath. Progressing farther right in FIG. 3 is shown the comb 12, and the top reed plate 13 with holes 2 and 1 being the farthest on the right in this drawing, showing the draw reed valve 21 and blow reed 18.

Figure 4:
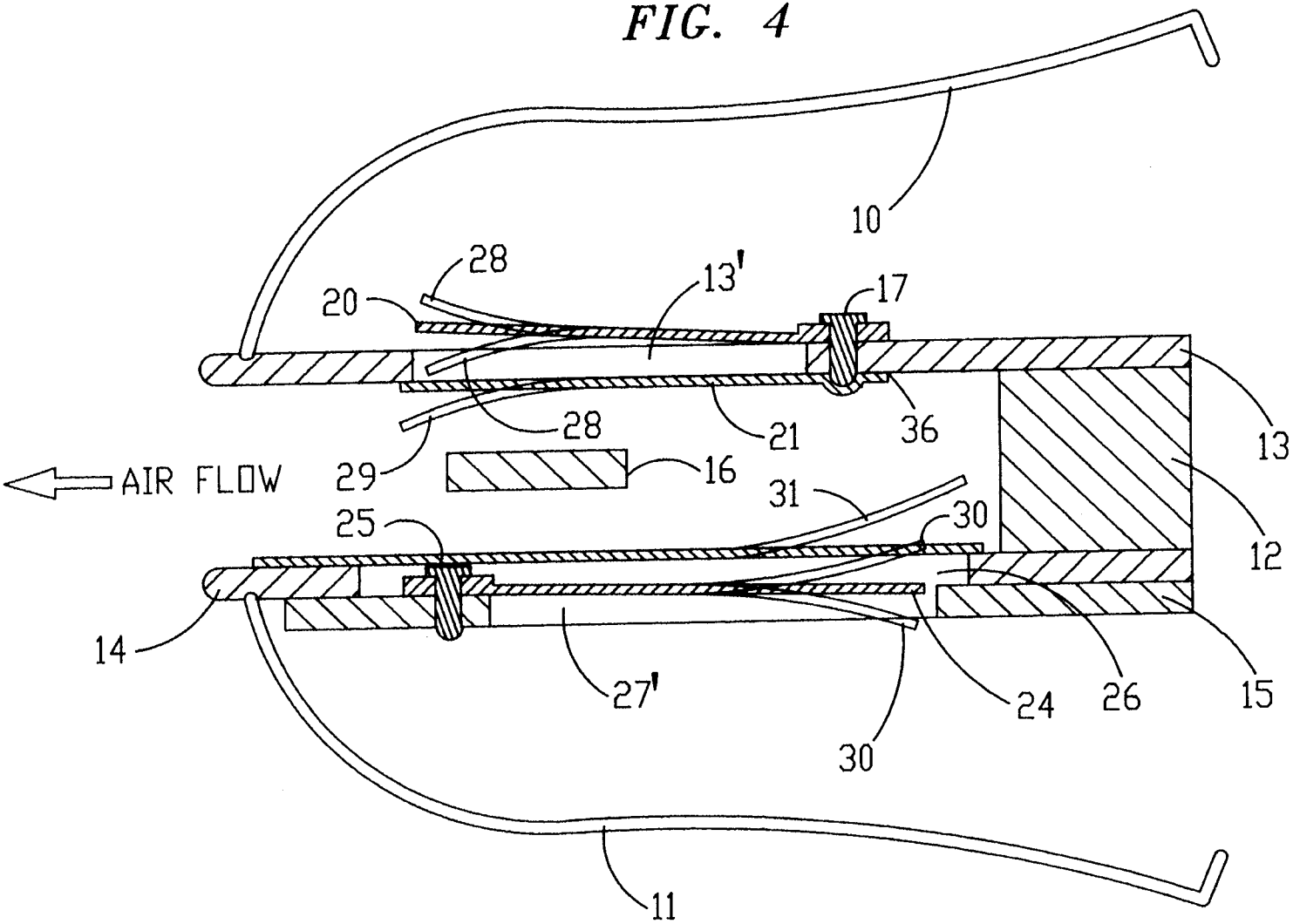
FIG. 4 is a sectional view, indicated by plane 4—4 of FIG. 3, showing one half of a typical cell of the harmonica.

FIG. 4 is a sectional view, indicated by plane 4—4 of FIG. 3, showing one half of a typical cell of the embodiment in FIG. 1. FIG. 4 shows the two reeds that are pertinent to drawing on the harmonica, being the draw reed 20 and the draw enabler reed 24. It is shown from the top down, the top cover 10 and the rivet 17 that attaches the draw reed 20, the top reed plate 13, a section of the reinforcement bar 16, being actually a part of the comb 12. Depicted by 36 in FIG. 4 is an adhesive line between the valve and rivet 36, in this case between the draw reed valve 21 and the tail end of rivet 17 that protrudes below the top reed plate. Shown in dotted lines are the draw reed in motion 28, while it is being played, and in dotted lines 29 we see the draw reed valve 21 in its open position. The draw reed valve 21 moves only in one direction, being a flapper type check valve, in this figure the direction is down. The draw reed 20 is free to vibrate in both directions. In the at rest position, the draw reed 20 is cocked up slightly above the surface of the top reed plate 13.

Farther down in FIG. 4 is the inside or second reed plate 14, the outside or second reed plate 15, and the bottom cover 11. The draw enabler reed valve 25 is shown attached to the inside or second reed plate 14. Shown in dotted lines 31 is the draw enabler reed valve while the draw reed is being bent. The draw enabler reed 24 is shown, and in dotted lines 30 is shown the draw enabler reed in motion while producing a bent note.

Figure 5:
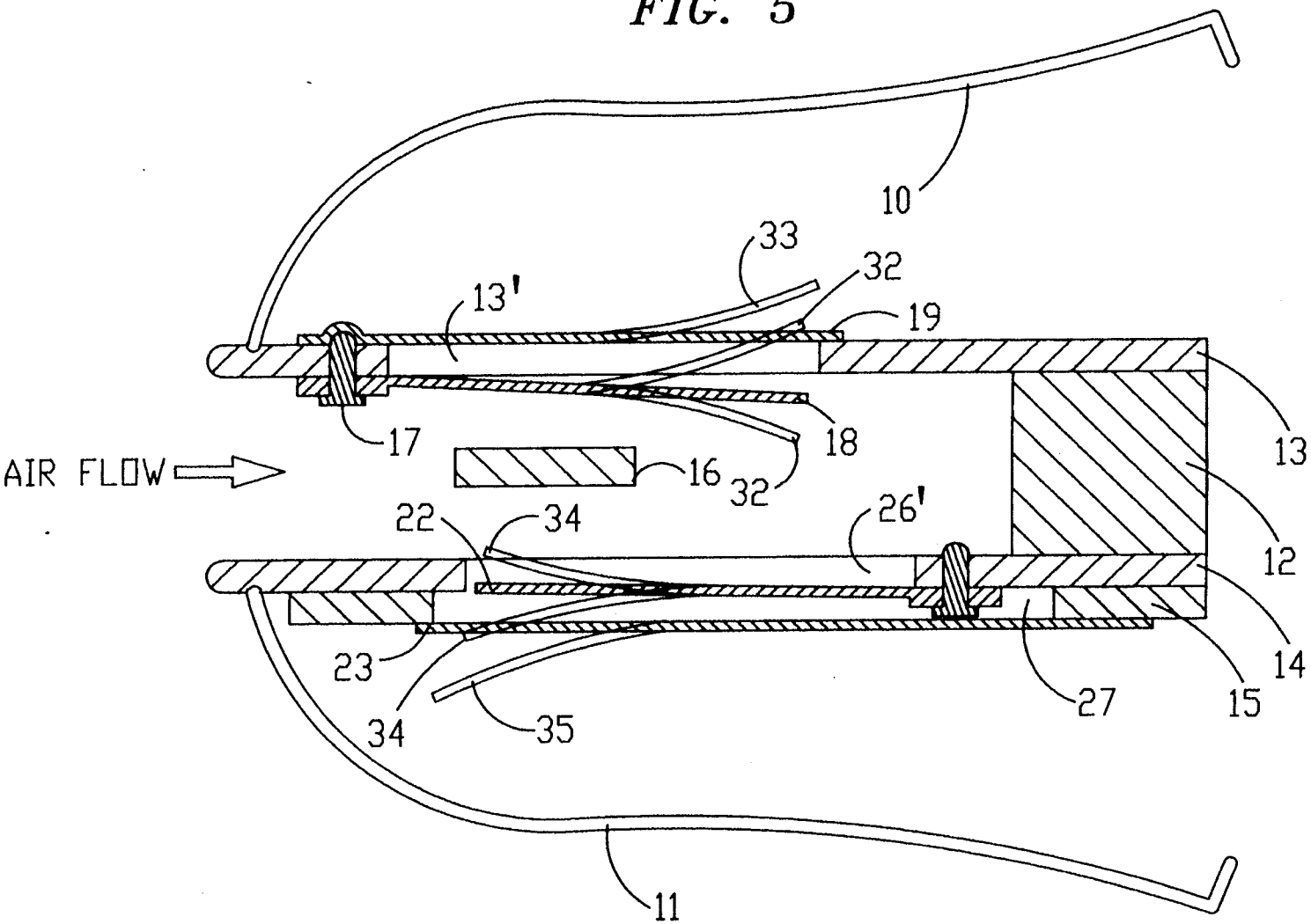
FIG. 5 is a sectional view, indicated by plane 5—5 of FIG. 3, showing the opposite half of a typical cell of the harmonica to that shown in FIG. 4.

FIG. 5 is a sectional view, indicated by plane 5—5 of FIG. 3, showing the opposite half of a typical cell of the harmonica to that shown in FIG. 4. FIG. 5 shows the two reeds that are pertinent to blowing on the harmonica, being the blow reed 18 and the blow enabler reed 22. Shown from the top down, the top cover 10 and the rivet 17 that attaches the blow reed 18, the top reed plate 13 and a section of the reinforcement bar 16 which is actually a part of the comb 12. Shown in dotted lines 32 are the blow reed in motion, while it is being played, and in dotted lines 33 we see the blow reed valve while the blow reed is in motion. The blow reed valve 19 moves only in one direction, being a flapper type valve, in this figure the direction is up. The blow reed 18 is free to vibrate in both directions. In the at rest position, the blow reed 18 is cocked down slightly below the surface of the first reed plate 13.

Farther down in FIG. 5 is the inside or second reed plate 14, the outside or third reed plate 15, and the bottom cover 11. The blow enabler reed valve 23 is shown attached to the outside or third reed plate 15. Shown in dotted lines 35 is the blow enabler reed valve while the blow reed is being bent. The blow enabler reed 22 is shown, and in dotted lines 34 is shown the blow enabler reed in motion producing a bent note.

Figure 6:
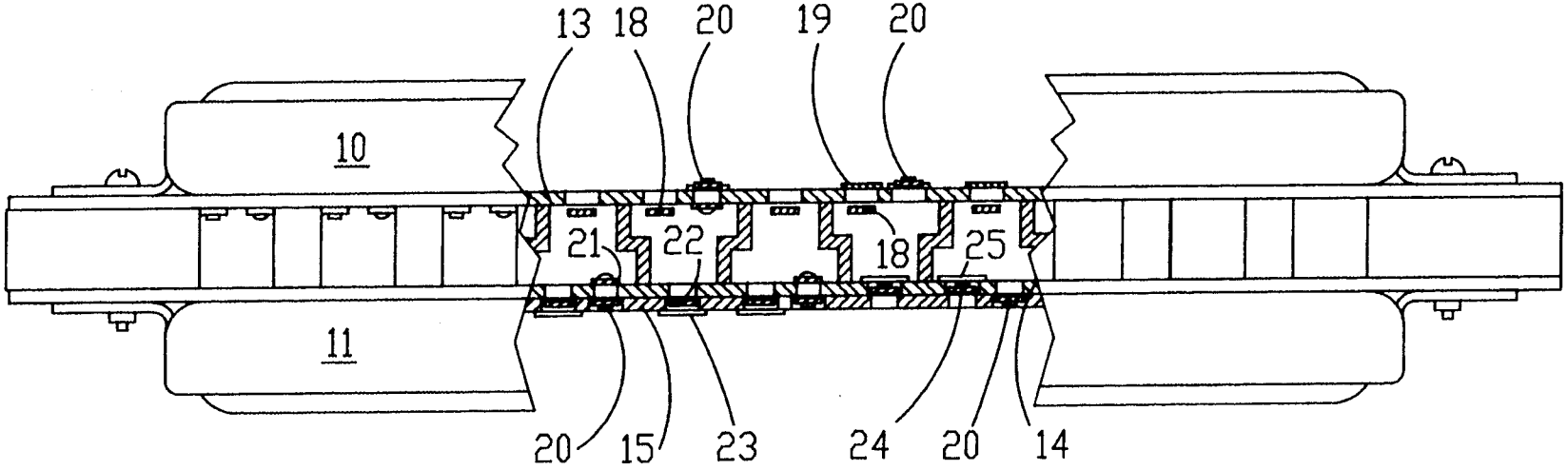
FIG. 6 shows a front elevational view, partially broken away, of a second embodiment of the invention showing three reeds per reed cell.

FIG. 6 shows the second embodiment which has only three reeds per reed cell instead of four. In this embodiment, the enabler reed for the higher pitched of the two regular reeds is left out, and instead the lower pitched regular reed acts as an enabler to bend the higher pitched of the two regular reeds. The cells, corresponding to the numbering scheme of a standard harmonica, are numbered 1 to 10 from left to right in this figure.

In FIG. 6 is depicted, along the top edge of the drawing a top cover 10, a first reed plate 13, a blow reed 18, a draw reed 20 attached to the first reed plate 13, a blow reed valve 19, and a blow reed 18. Also shown, along the bottom edge of the drawing, is the bottom cover 11, a draw reed valve 21, a draw reed 20 attached to the inside or second reed plate 14, the outside or third reed plate 15, a blow enabler reed 22, a blow enabler reed valve 23, a draw enabler reed valve 25, and a draw enabler reed 24. The blow reeds 18 are all occupied on the first reed plate 13 in this embodiment. The draw reeds 20 alternate between the first reed plate 13 and the inside or second reed plate 14. The blow enabler reeds 22 and draw enabler reeds 24 all are attached to either of the second or third reed plates. The blow enabler reeds 22, located in holes 1 through 6, are attached to the inside or second reed plate 14. The draw enabler reeds 24, located in holes 7 through 10, are attached to the outside or third reed plate 15.

Figure 7:
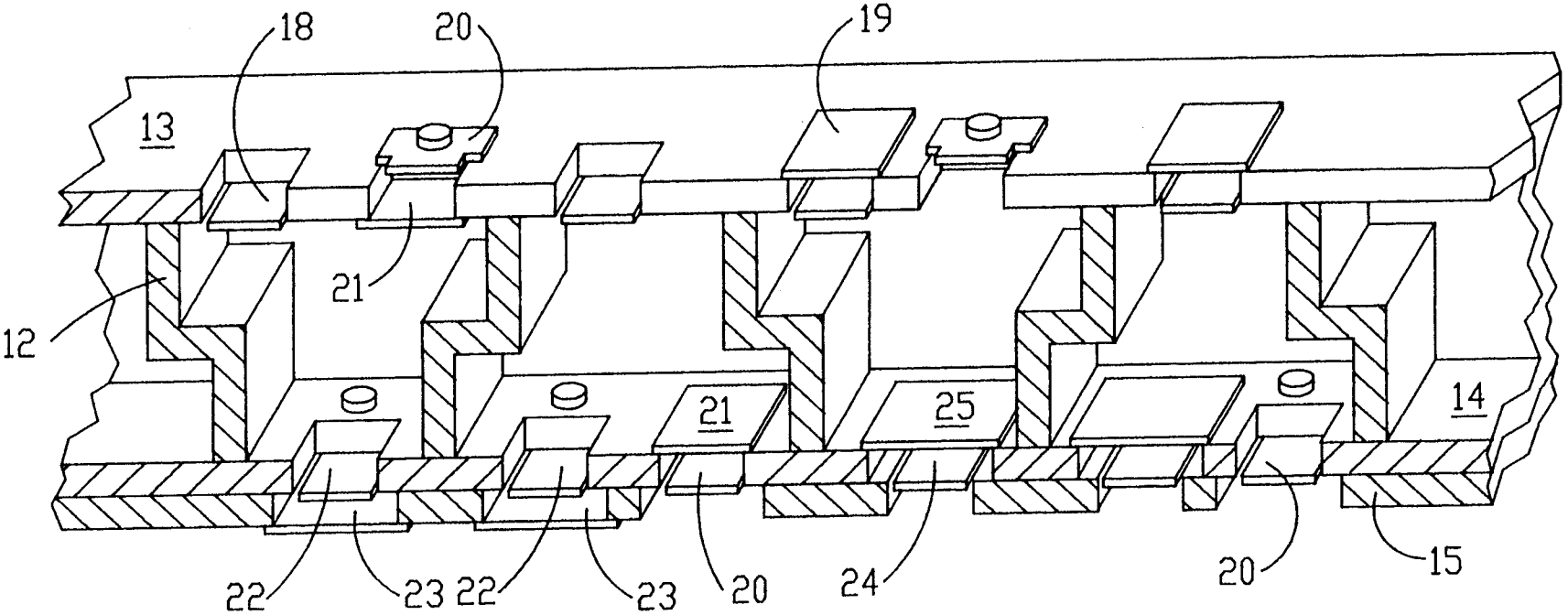
FIG. 7 shows a perspective view of a section broken away of the harmonica shown in FIG. 6.

FIG. 7 shows a perspective view of a section broken away of the second embodiment shown in FIG. 6. Starting from the top left corner of the drawing, and proceeding left to right is shown the top reed plate 13, a blow reed 18, a draw reed 20 attached to the top reed plate 13, and a blow reed valve 19. On the next level down is shown a section of the comb 12 and a draw reed valve. Along the bottom edge of the cells is shown a draw reed valve 21, a draw enabler reed valve 25 and the bottom inside reed plate 14. Along the bottom edge of the drawing are depicted two blow enabler reeds 22, two blow enabler reed valves 23, a draw reed 20, a draw enabler reed 24, a draw reed 20, and the bottom outside reed plate 15.

FIG. 8 is a table showing the notes to which the reeds are tuned and the musical notes that can be obtained in the preferred embodiment and the third embodiment, 40-reed harmonicas, when they are tuned to musical key C.

FIG. 9 is a table showing the notes to which the reeds are tuned and the musical notes that can be obtained in the second embodiment, the 30-reed harmonica shown in FIG. 6 when it is tuned to musical key C.

Figure 10:
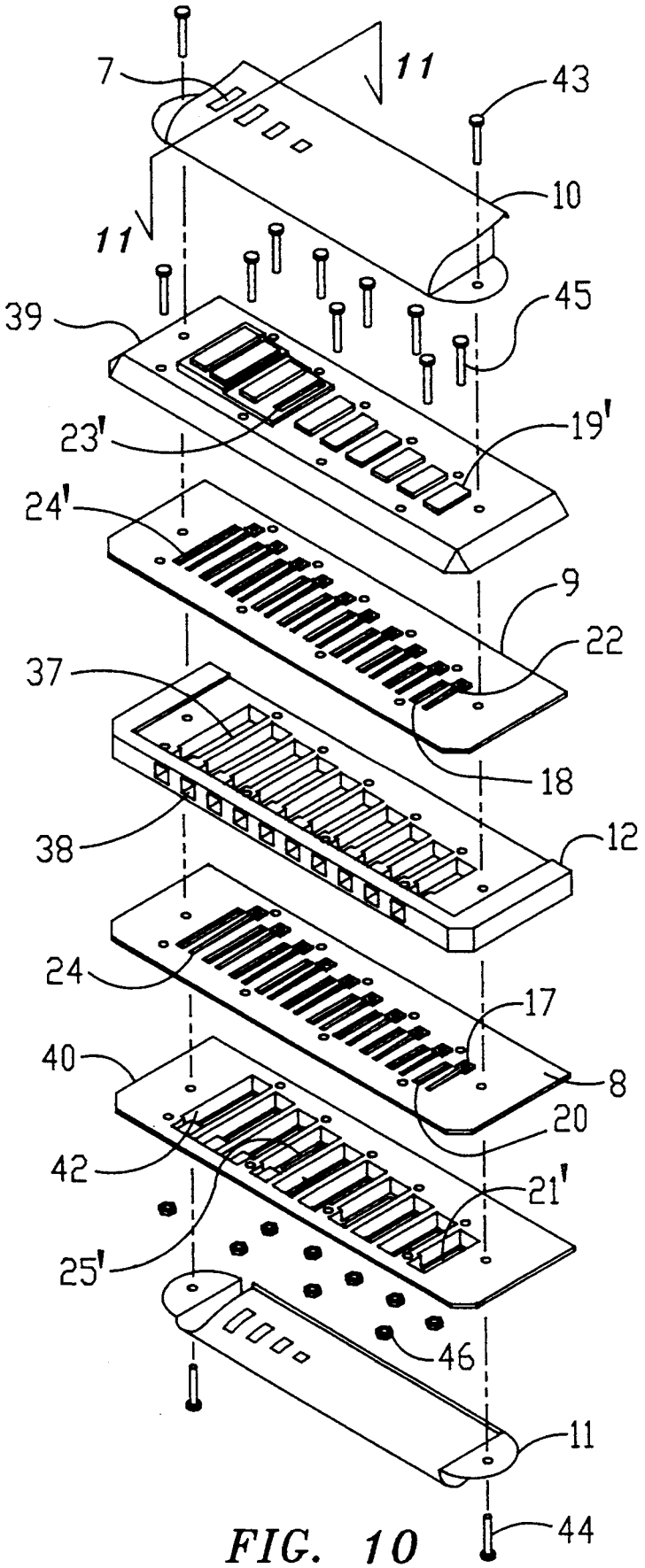
FIG. 10 shows an exploded view of a third embodiment of the invention.

FIG. 10 shows an exploded perspective view of the third embodiment, with one blow reed/blow enabler reed valve and one draw reed/draw enabler reed valve omitted so that the valve slots can be seen. Starting from the top of the drawing and proceeding down is shown a sound hole 7, a cover screw 43, the top cover 10, a reed plate screw 45, the blow valve platform 39 which serves as a valve plate, a blow reed/blow enabler reed valve slot 23', a blow reed/blow enabler reed valve 19', a reed slot 24', a blow enabler reed 22, the blow reed plate 9, a blow reed 18, a cell wall 37, a mouthpiece opening 38, the comb 12, a draw enabler reed 24, the draw reed plate 8, a rivet 17, a draw reed 20, the draw valve platform 40, a draw valve cell 42, a draw reed/draw enabler reed valve slot 25', a draw reed/draw enabler reed valve 21', a reed plate nut 46, the bottom cover 11 and a cover nut 44.

Figure 11:
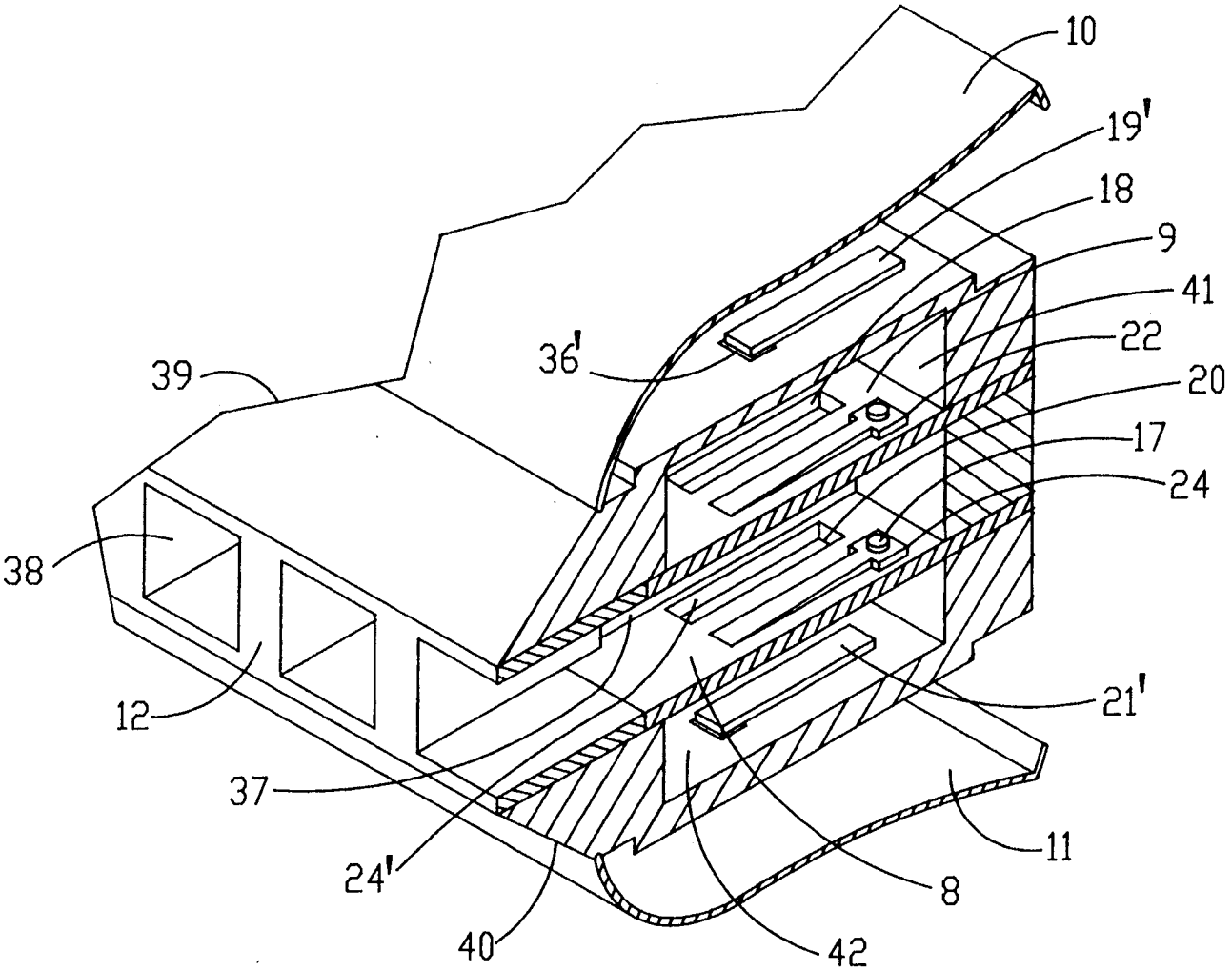
FIG. 11 shows a broken away cross-section in perspective of the unexploded harmonica taken on Section 11/11 of FIG. 10.

FIG. 11 is a perspective view of a section indicated by plane 11—11 of FIG. 10, showing a typical cell of the third embodiment. Starting from the top of the drawing and proceeding down is shown the top cover 10, an adhesive line between valve and valve platform 36', a blow reed/blow enabler reed valve 19', the blow valve platform 39, a blow reed 18, a blow valve cell 41, the blow reed plate 9, a blow enabler reed 22, a mouthpiece opening 38, the comb 12, a cell wall 37, a reed slot 24', a draw reed 20, the draw reed plate 8, a rivet 17, a draw enabler reed 24, the draw valve platform 40, a draw valve cell 42, a draw reed/draw enabler reed valve 21', and the bottom cover 11.

The comb and valve platforms are preferably constructed of plastic or metal. The reed plates and covers are preferably constructed of metal.

The novel features of the third embodiment involve pairing the blow reeds with their blow enabler reeds on a single plate, and the draw reeds with their draw enabler reeds on a single and different plate from the blow reeds. Also, the blow reed/blow enabler reed valves are mounted on a blow valve platform and are not in any contact whatsoever with the blow reed plate. Similarly, the draw reed/draw enabler reed valves are mounted on a draw valve platform and have no contact with the draw reed plate.

FIG. 12 shows the notes which can be obtained in the third embodiment when the normal reeds are tuned to the standard, 10-hole/20-reed or Richter tuning in the key of C, and the enabler reeds are tuned 20 to 40 cents flat of the lowest shown bent note in each position. This tuning allows each note to be bent 2 half steps, with the third hole draw allowing a bend of three half steps.

The third embodiment may also be tuned to any other desired harmonica tuning or scale, also the enabler reeds may be tuned to allow bends of one, two or more half steps on each note. This is achieved by tuning each enabler reed 20 to 40 cents flat of the lowest desired bent note in its position.

In all three embodiments, the blow enabler reed valves 23 and the draw enabler reed valves 25 are preferably constructed of a coated plastic, the coating being necessary to prevent the plastic from sticking to the reed plate from moisture in the air passing through it in normal use. The blow reed valves 19 and draw reed valves 21 are also constructed of coated plastic. These are the same plastics currently used in harmonica valves.

Operation—FIGS. 1, 4, 5, 6, 8, 9, 10, 11

The manner in which one uses the bending harmonica to produce musical notes is similar to that used in the existing 10 cell, 20 reed, diatonic harmonica. For both the preferred embodiment and the third embodiment, both 40-reed bending harmonicas, and the second embodiment, the 30-reed bending harmonica, draw notes are produced by drawing air from the instrument with the mouth and the tongue of the player in the non-bending position. Referring to FIG. 8, the 10 notes depicted on the draw reed line are produced in cells 1 to 10, depending on which is being drawn on, for a 40-reed harmonica tuned to key C. These same 10 draw notes are produced with the 30-reed version as given on the draw reed line of the table in FIG. 9, for a 30-reed harmonica tuned to key C, when drawing in the non-bending position.

For both the 40 reed version and for the 30 reed version of the bending harmonica, the identically same blow notes are produced with the mouth and tongue in the non-bending position, shown on the blow reed lines of FIGS. 8, 9 and 12.

With the 30-reed version of the bending harmonica, twelve additional notes are possible, while blowing with the mouth and tongue in the bending position in cells 1 through 10. These are depicted on the possible blow bent notes line in FIG. 9. Thirteen more notes are possible with the 30-reed version with the mouth and tongue in the bending position while drawing on the instrument in cells 1 through 10. These are shown on the possible draw bent notes line in FIG. 9.

Using the preferred embodiment of the bending harmonica, fourteen additional notes are possible, while blowing with the mouth and tongue in the bending position in cells 1 through 10. These are depicted on the possible blow bent notes line in FIG. 8. Fifteen more notes are possible with the preferred embodiment with the mouth and tongue in the bending position while drawing on the instrument in cells 1 through 10. These are shown on the possible draw bent notes line in FIG. 8.

Using the third embodiment, 20 additional notes are possible while blowing on the harmonica with the mouth and tongue in the bending position in holes or cells 1 through 10. These are depicted on the possible blow bent notes line in FIG. 12. Twenty-one additional notes are possible with the third embodiment with the mouth and tongue in the bending position while drawing on the instrument in holes (or cells) 1 through 10. These are depicted on the possible draw bent notes line in FIG. 12.

The musical range is expanded beyond that available on the 10 cell, 20 reed, diatonic harmonica by adding enabler reeds and enabler reed valves to each cell of the harmonica. Referring to FIG. 1, the preferred embodiment, a 40-reed bending harmonica, two enabler reeds are added per reed cell. A blow enabler reed 22, blow enabler reed valve 23, draw enabler reed 24, and draw enabler reed valve 25 are added to each cell.

The use of a single auxiliary reed mounted flush over a slot in a cell for bending has been suggested before this invention and no claim is made to this invention. However, such feature is unsatisfactory when multiple adjacent cells are used in a harmonica because of undesirable sympathetic vibration of reeds in adjacent cells. The use of enabler reed valves eliminate this problem and make possible the improved harmonica of this invention.

To allow the enabler reeds to work optimally, the enabler reeds must be mounted so that the enabler reed tongue, or free end, is flush with its slot in the reed plate on which it is mounted. In addition, the area on the top side of the enabler reed, the side which the tongue is close to, must be isolated by building a wall around it and attaching a valve on the side not normally valved. The means by which the enabler reeds are isolated is by a double reed plate, two reed plates sandwiched together where each reed plate acts as the isolating wall around the reeds on the other reed plate.

These novel features can best be illustrated by referring to FIGS. 4 and 5. FIG. 4 shows the novel features for producing the draw bending notes. The draw reed 20 is mounted as it would be on a standard 10 cell, 20 reed, diatonic harmonica, mounted flush to the first reed plate 13, with the tip of the reed tongue slightly above the top surface of the first reed plate 13. The only difference being that in the standard harmonica, the draw reeds are normally mounted to the bottom reed plate.

Referring to FIG. 4, when drawing on the cell with the mouth and tongue in the non-bending position, the draw reed valve 21 opens and the draw reed 20 vibrates, producing the musical note that the draw reed 20 is tuned to. When the mouth and tongue are shifted to the bending position, the draw enabler reed valve 25 is opened by the higher velocity of the air being drawn, and the draw enabler reed 24 is stimulated to vibrate and sound. The musical note produced is lower than the draw note produced in this particular cell. The amount the bent note is lower is determined by the tuning of the draw enabler reed 24. Since the draw enabler reed can be set to any reasonable predetermined pitch or frequency below the draw reed, the amount of bending is relatively unrestricted. The particular features that allow this device to act in this manner are:

(a) The check valving of the draw enabler reed 24 and the draw reed 20.

(b) The preferred flush mounting of the tongue of the draw enabler reed 24, flush with the outside or third reed plate 15.

(c) The double reed plate, including the outside or third reed plate 15 and the inside or second reed plate 14, which allows the draw enabler reed 24 to be mounted to the top surface of the outside or third reed plate 15. It also allows isolation through valving of the top side of the draw enabler reed 24 by permitting an inside or second reed plate large slot 26 that is somewhat larger than the draw enabler reed 24 which is mounted adjacent the outside reed plate small slot 27', which is just slightly larger than the tongue of the enabler reed. The enabler valve eliminated unwanted sympathetic vibration from adjacent cells in the harmonica.

FIG. 5 shows the novel features for producing the blow bending notes. The blow reed 18 is mounted as would be on a standard 10 cell, 20 reed, diatonic harmonica, mounted flush to the first reed plate 13, with the tip of the reed tongue slightly below the bottom surface of the top reed plate 13. When blowing on the cell with the mouth and tongue in the non-bending position, the blow reed valve 19 opens and the blow reed 18 vibrates, producing the musical note that the blow reed 18 is tuned to. When the mouth and tongue are shifted to the bending position, the blow enabler reed valve 23 is opened by the higher velocity of the air being blown, and the blow enabler reed 22 is stimulated to vibrate and sound. The musical note produced is lower than the blow note produced in this particular cell. The amount the bent note is lower is determined by the tuning of the blow enabler reed 22. Since the blow enabler reed can be set to any reasonable predetermined pitch or frequency below the blow reed predetermined pitch, the amount of bending is relatively unrestricted. The particular features that allow this device to act in this manner are:

(a) The check valving of the blow enabler reed 22 and the blow reed 18. The blow reed valve 19 and the blow enabler reed valve 23 accomplish this check valving.

(b) The preferred flush mounting of the tongue of the blow enabler reed 22, flush with the bottom inside reed plate 14.

(c) The preferred double reed plate, including the bottom outside reed plate 15 and the inside or second reed plate 14, which allows the blow enabler reed 22 to be mounted to the bottom surface of the inside or second reed plate 14. It also allows isolation through valving of the bottom side of the blow enabler reed 22 by permitting an outside or third reed plate large slot 27 that is somewhat larger than the blow enabler reed 22 which is mounted adjacent the inside reed plate small slot 26' and is just slightly larger than the tongue of the enabler reed. The enabler valves eliminate unwanted sympathetic vibration from adjacent cells in the harmonica.

By way of completely check valving every reed in the reed cell, air loss is reduced and the compression and volume of the harmonica is greatly increased. This valving would include, in FIG. 4, the draw reed valve 21 and the draw enabler reed valve 25, and in FIG. 5, the blow reed valve 19 and the blow enabler reed valve 23.

By tuning the enabler reeds as desired, the instrument is able to achieve the bending of notes to the degree desired, allowing the player to obtain the entire chromatic scale and also achieve glissando, or sliding up and down the musical scale, imparting a more fluid and live quality to the music.

The specific features of the second embodiment, shown in FIG. 6, operate in much the same manner as in the preferred embodiment. The advantages to the second embodiment are:

(a) It should be cheaper to produce, because there are only 30 reeds instead of 40 reeds in the instrument.

(b) The size of the harmonica can be smaller than the 40-reed version. It can be made to nearly the size of the normal 10 cell, 20 reed harmonica.

The disadvantages of the second embodiment are:

(a) The higher notes, produced by holes 5 and 7, being only a half-step higher than the lower notes can still only be bent approximately a quarter of a tone, because the enabler reed is only a half-step below the regular reed. All of the notes that you can normally bend on a regular harmonica you can bend to the same degree on the second embodiment, whether it be only a quarter of a tone, a half tone or more. All the notes that you cannot bend at all normally on the regular 10 cell harmonica you can bend however much you want to bend on the second embodiment.

(b) Compared to the preferred embodiment, not as much volume and compression are available in the 30-reed version, as not all the reeds are valved.

(c) Compression is not completely balanced between blowing and drawing. When you blow into holes 1 through 6, you don't have quite the same degree of volume as you do when you draw, because the blow reeds can have no reed valve, or can have valves covering only about half way, in order for the blow reed to remain exposed so as to act as an enabler for the draw reed, and vice versa for holes 7 through 10.

The manner in which one uses the third embodiment of FIGS. 10 and 11 is similar to that used in the first embodiment of the bending harmonica. The third embodiment, having 40 reeds as does the first embodiment, has the same musical range as does the first embodiment.

The means by which the enabler reeds are isolated from airflow which would cause undesirable sympathetic actuation, is by a valve platform which provides isolating walls around the reeds, as well as slots for check valves. This novel feature can best be illustrated by referring to FIG. 11. FIG. 11 shows a blow reed 18 and a blow enabler reed 22 isolated on the outside by means of a single blow valve cell 41 in the blow valve platform 39, and a blow reed/blow enabler reed valve 19'. Also shown is a draw reed 20 and a draw enabler reed 24 isolated on their outsides by means of a single draw valve cell 42 in the draw valve platform 40 and a draw reed/draw enabler reed valve 21'.

The valve platform allows isolation of the top sides of the enabler reeds through valving in a manner similar to the valving of the large slows 26 and 27 in the double reed plate of the first embodiment, as well as the isolation of the bottom surface of the regular blow and draw reeds through valving, in a manner similar to the valving of the small slots 13' in the first reed plate of the first embodiment.

The operation of the various reeds, enabler reeds and check valves in the third embodiment, with respect to playing bending notes and non-bending notes, is similar to that of the first embodiment.

The valve platforms, in serving the same function as the large slots 26 and 27 of the first embodiment thus eliminate the need for a double reed plate and permit the use of two standard chromatic-type reed plates.

The advantages of the third embodiment are as follows:

(a) The number of valves required is decreased from 40 to 20, as each valve serves both a normal reed and its enabler reed.

(b) The area and volume between each reed-enabler reed pair and its valve, which in this embodiment is described as a valve cell, is greatly increased over that of the first two embodiments, and allows for freer reed vibration, easier note bending and richer tonality.

(c) The reed plates, not having as narrow dividing walls between slots as are found in the second and third reed plates of the first embodiment, are structurally more stable.

(d) The positioning of the check valves independent of the reed plates allows for easier adjusting and tuning of the reeds and handling of the reed plates during production and servicing.

(e) All check valves lie on the upper surface of their valve platforms (outer surface of the blow valve platform and inner surface of the draw valve platform) when played in the normal position of low notes to the left, high notes to the right, allowing gravity to assist their return to closed position after a note is sounded.

SUMMARY, RAMIFICATIONS AND SCOPE

Accordingly, bending harmonicas of this invention can be used to increase the musical range of the standard 10 cell, 20 reed, diatonic harmonica. Furthermore, the bending harmonicas have the further advantages of:

(a) allowing musical notes to be bent to any degree wished, by a predetermined adjusting of the tuning or pitch of the various reeds in the instrument;

(b) enabling a player to achieve a complete chromatic scale with the harmonica;

(c) permitting a player to produce a glissando on each and every note, thereby imparting a more fluid and live quality to the music; and (d) increasing the volume and compression of the instrument.

The third embodiment, because of its advantages, could be considered the preferred embodiment by those desiring these features.

Specific advantages of the third embodiment are:

(1) The number of reed valves have been reduced from 40 to 20, minimizing noise and improving response time, as well as providing a wider margin for easy reed valve positioning during assembly. (2) The reed valves are completely separate from and unattached to reed plates, further simplifying assembly, servicing and tuning. (3) This embodiment possesses standard-type, single thickness reed plates which can be produced on existing chromatic reed plate tooling.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

What is claimed is:

1. A harmonica comprising:

a multiplicity of adjacent mouthpiece openings;

a draw reed of a first predetermined pitch associated with each of said mouthpiece openings;

a blow reed of a second predetermined pitch associated with each of said adjacent mouthpiece openings which is of a different frequency than said first predetermined pitch of said draw reed;

a draw enabler reed of a predetermined pitch associated with each of said adjacent mouthpiece openings;

a draw reed/draw enabler reed valve associated with each of said mouthpiece openings for said draw enabler reed;

a blow enabler reed of predetermined pitch associated with each of said mouthpiece openings; and a blow reed/blow enabler reed valve associated with each of said adjacent mouthpiece openings for said blow enabler reed and for said blow reed.

2. The harmonica of claim 1 which further includes:

a comb;

spaced apart cell walls located along said comb defining multiple adjacent cells; and said mouthpiece openings spaced along said comb leading into said multiple adjacent cells with the width of said openings being substantially less than the distance between said spaced apart cell walls.

3. The harmonica of claim 1 which further includes:

a blow reed plate for mounting said blow reeds and said blow enabler reeds;

a blow valve platform contiguous to said blow reed plate for mounting said blow reed/blow enabler reed valves;

a draw reed plate for mounting said draw-reeds and said draw enabler reeds; and a draw valve platform contiguous to said draw reed plate for mounting said draw reed/draw enabler reed valves.

4. The harmonica of claim 3 wherein each pair of said blow reeds and said blow enabler reeds are mounted side by side on opposite sides of said blow reed plate and each pair of said draw reeds and said draw enabler reeds are mounted side by side on opposite sides of said draw reed plate.

5. The harmonica of claim 4 wherein said blow valve platform contains a blow valve cell overlying each blow reed and blow enabler reed pair with one of said blow reed/blow enabler reed valves mounted on a slot connected to said blow valve cell opposite said reeds and said draw valve platform contains a draw valve cell overlying each draw reed and draw enabler reed pair with one of said draw reed/draw enabler reed valves mounted on a slot connected to said draw valve cell opposite said reeds.

6. The harmonica of claim 2 wherein all of said blow reds and said blow enabler reeds are on one side of said comb and all of said draw reeds and draw enabler reeds are on the opposite side of said comb from said blow reeds and said blow enabler reeds.

7. A reed plate for use with an harmonica;

a plurality of elongated slots in said plate parallel to one another;

a blow or draw reed mounted in association with every other one of said slots; and a blow enabler reed or draw enabler reed mounted in association with the remainder of said slots.

8. The reed plate of claim 7 wherein all the reeds in said reed plate are either blow reeds and blow enabler reeds or draw reeds and draw enabler reeds.

* * * * *